United States Patent [19]

Chesler

[11] Patent Number: 5,052,636

[45] Date of Patent: Oct. 1, 1991

[54] DAMPED FILAMENT DISPENSER

[75] Inventor: Ronald B. Chesler, Woodland Hills, Calif.

[73] Assignee: Hughes Aircraft Company, Los Angeles, Calif.

[21] Appl. No.: 430,699

[22] Filed: Nov. 1, 1989

[51] Int. Cl.[5] ..... F42B 12/68; F42B 15/04; B65H 49/00; B65H 55/00

[52] U.S. Cl. ..... 244/3.12; 102/504; 242/128; 242/156; 242/159; 242/170

[58] Field of Search ..... 244/3.12; 102/504; 89/1.34; 242/128, 129, 156, 159, 170, 54 R; 226/97

[56] References Cited

U.S. PATENT DOCUMENTS

| | | | |
|---|---|---|---|
| 3,232,557 | 2/1966 | Winn | 242/146 |
| 3,305,150 | 2/1967 | Campbell et al. | 226/97 |
| 3,319,781 | 5/1967 | Simpson et al. | 244/3.12 |
| 3,613,619 | 10/1971 | Nobel et al. | 244/3.12 |
| 4,326,657 | 4/1982 | Arpin et al. | 102/504 |
| 4,508,285 | 4/1985 | McMillan | 242/159 |
| 4,903,607 | 2/1990 | Clark | 244/3.12 |

*Primary Examiner*—David H. Brown

*Attorney, Agent, or Firm*—R. M. Heald; C. D. Brown; W. K. Denson-Low

[57] ABSTRACT

A missile data link filament (12) dispenser (10) is located within an enclosure (20) having a single eyelet opening (26) through which the filament feeds on launch. A quantity of a particulate material (28) located within the enclosure (20) is converted to an aerosol mixture by the filament movement on dispense. The aerosol mixture serves to act as a brake on the filament preventing dispense speed exceeding a predetermined desirable maximum.

9 Claims, 2 Drawing Sheets

DAMPED FILAMENT DISPENSER

BACKGROUND OF THE INVENTION

1. Field of the Invention

The present invention relates generally to a filament dispenser for a missile or other moving vehicle, and, more particularly, to a filament dispenser which damps transverse oscillations of the unspooling filament.

2. Description of Related Art

A number of missiles remain interconnected with control apparatus upon launch by a filament, either wire or preferably an optical fiber, via which navigational information is exchanged over at least a part of the missile travel path. These filaments are typically wound into a pack carried on the missile, or other vehicle, and care must be taken in the manner of unspooling the filament (dispensing) to prevent damage to the filament.

One difficulty encountered on dispensing a wound filament pack, especially at high speeds, is the tendency for the filament to form helical loops of relatively large amplitude extending transversely of the dispensing direction. Such loops require a correspondingly large exit port for filament dispensing which may be undesirable. Also, the loops on leaving the vehicle experience air drag in an amount dependent upon size which is desirably kept to a minimum. Still further, the radar cross-section of the vehicle (i.e., detectability) is accordingly maintained at a size larger than desired. The loops also prevent ducting of dispensed filament prior to release into the ambient airstream.

It is, therefore, highly desirable to provide a filament dispensing technique ideally producing a linear trajectory allowing dispense from a small exit port. Also, all of this should be accomplished without subjecting the filament to significant risk of damage, destruction or reduction in signal transmission capabilities.

SUMMARY OF THE DISCLOSURE

In accordance with the present invention a wound pack of filament is fixedly mounted within an enclosure secured to the missile or other vehicle. The enclosure has a single small opening (eyelet) through which the filament is dispensed.

Prior to or at launch, the enclosure is filled with an aerosol mixture which has sufficient density to damp the unspooling filament transverse kinetic energy so that linear payout results. Not only are the already referenced advantages obtained, but a linear dispense trajectory is advantageous in enabling avoidance of the rocket plume which could otherwise destroy or damage the filament.

DESCRIPTION OF PREFERRED EMBODIMENTS

Figure 1:
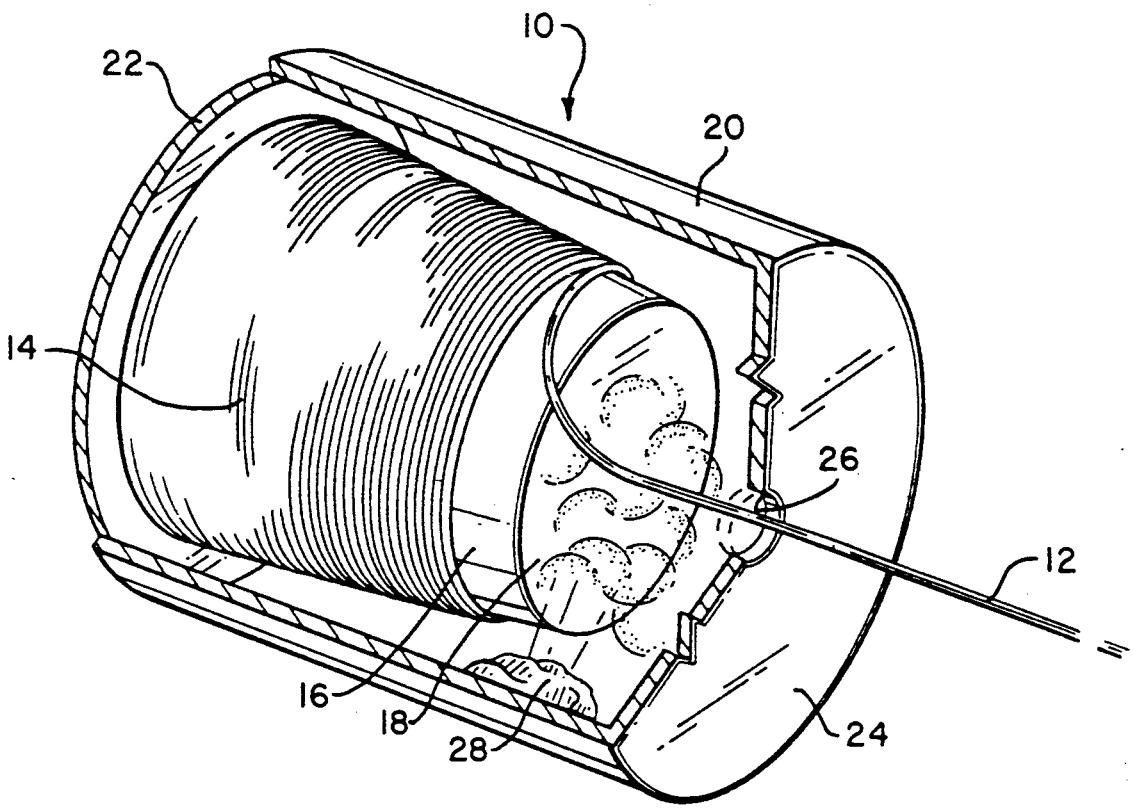
FIG. 1 is a perspective, partially fragmentary view of a first form of the invention.

Turning now to the drawing and particularly FIG. 1, the filament dispensing apparatus of the invention is enumerated generally as 10. More particularly, a filament 12 is wound into a pack 14 on a cylindrical drum 16 which is tapered to a relatively smaller diameter takeoff end 18.

A hollow enclosure 20 is cylindrical and of such internal dimensions as to enable coaxially securing the large end of the drum 16 to the closed end wall 22, while at the same time providing space for the filament to be taken off the pack without contacting the enclosure walls. The enclosure end wall 24 opposite the drum small end 18 includes a small opening or eyelet 26 through which the filament 12 passes on dispense.

The outer end of the filament 12 interconnects with apparatus located at the launch site (not shown) while the other end of the filament is similarly connected to on-board apparatus (not shown). Neither of these apparatus nor the connections thereto are shown since they are conventional and detailed understanding is not necessary for a full understanding of this invention.

In accordance with the present invention, a quantity of an aerosol powder 28 is openly positioned within the enclosure 20. Immediately upon the filament beginning dispense, the moving filament agitates to the aerosol powder causing it to form an aerosol mixture or suspension within the enclosure. The aerosol mixture is sufficiently dense to act as a brake upon the filament reducing the formation of transverse loops. That is, the aerosol mixture provides an aerodynamic drag to the unspooling filament which damps transverse kinetic energy permitting the filament to exit via eyelet 26 along a substantially linear trajectory.

In explanation, it is known that braking of an unspooling filament by contact with a solid surface reduces transverse "ballooning" of the filament. However, such braking is not completely satisfactory in that the filament may be subject to undue abrasion and tensile forces resulting in undesirable bending, kinking or even severing of the filament. In seeking a substitute for mechanical braking, liquids were considered for use in the enclosure, but all were found to be too dense resulting in excessive filament tensile stress on dispense. Failing to find a liquid within the necessary density range, gases were considered; however, no gas could be found having a sufficiently high density to provide satisfactory damping.

An aerosol mixture which consists essentially of very fine solid or liquid particulate matter suspended in a gas has been found to possess the required range of density, namely, greater than that of any gas found but less than that of a liquid.

Although other aerosol materials and amounts may be found advantageous, for an enclosure having an interior 30 cm long and 15 cm in diameter, 300 gms of molybdenum disulfide powder (sold under the trade designation Z-Powder) will be kept air borne within the enclosure by the filament unspooling movement and at the same time provide the desired filament braking.

Although an optimum density has not been determined as yet, it is clear that an aerosol mixture having a density of less than about 10 times the density of air will be insufficient. On the other hand, an aerosol mixture density exceeding 100 times that of air is too great for filament safety or to insure satisfactory signal transmission.

As an alternative embodiment, the filament dispensing apparatus 10a is constructed such that the aerosol mixture can be supplied from a pressurized source 30 and selectively injected into the enclosure 20 a via a nozzle 32. Results obtained are the same as in the first described embodiment.

Figure 4:
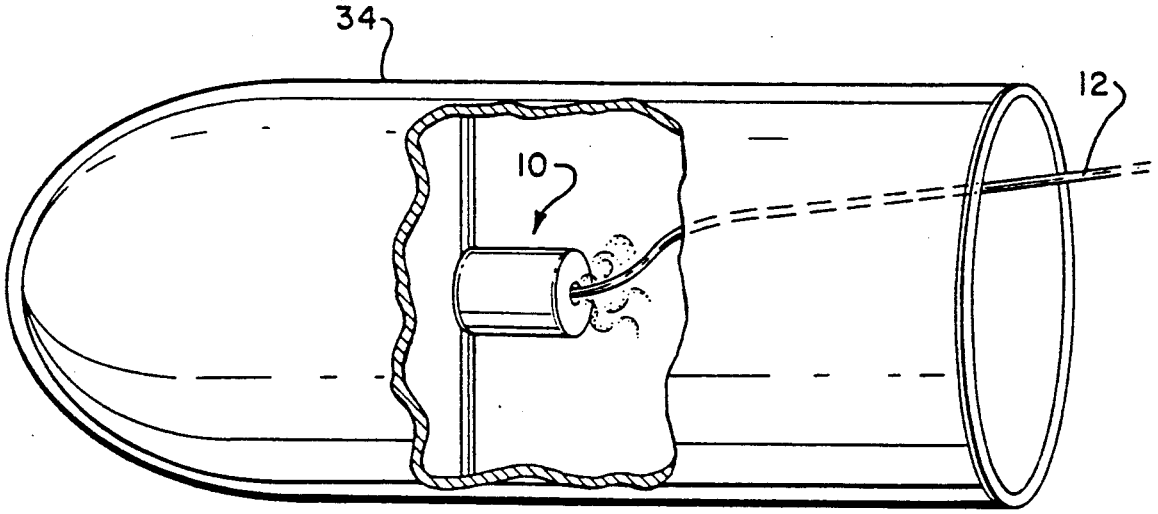
FIG. 4 is a side elevational view of a missile incorporating the invention.

FIG. 4 depicts general filament dispensing from a missile 34. As shown, the filament dispenser 10 is located generally midships and the filament 12 extends outwardly of the missile for connection with apparatus at the launch site (not shown). At launch, the filament unwinds maintaining the interconnection for the required part of the flight path.

Figure 2:
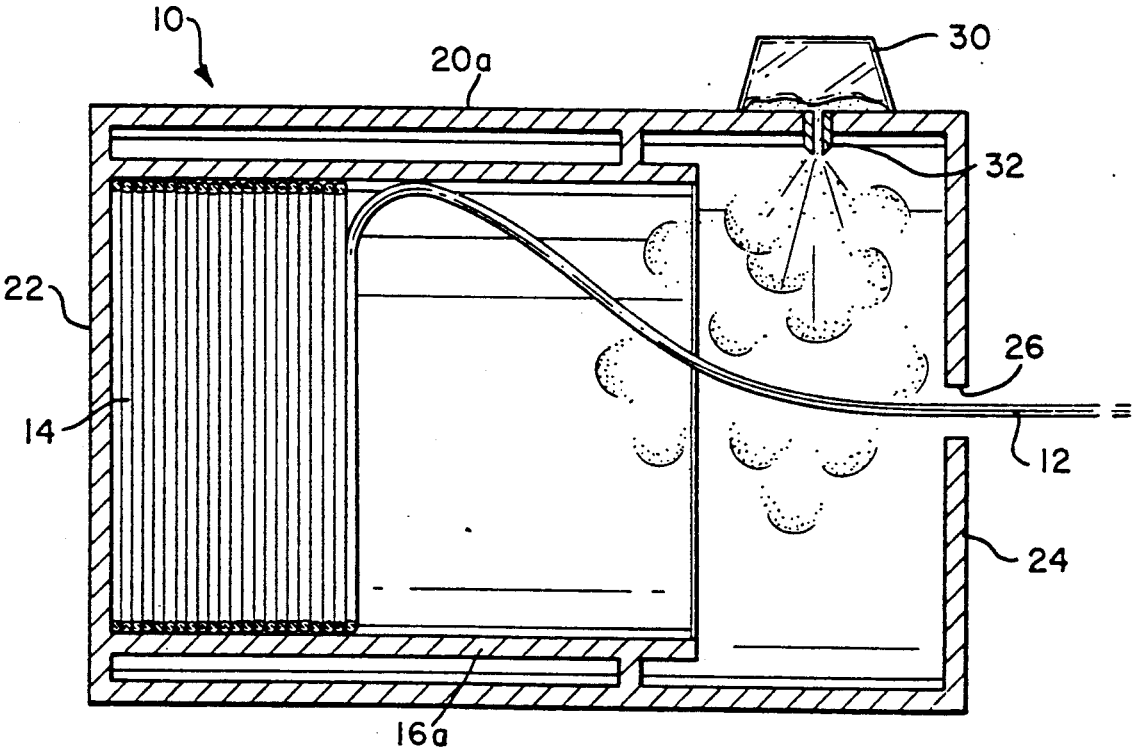
FIG. 2 is a side elevational view of an alternative embodiment.
Figure 3:
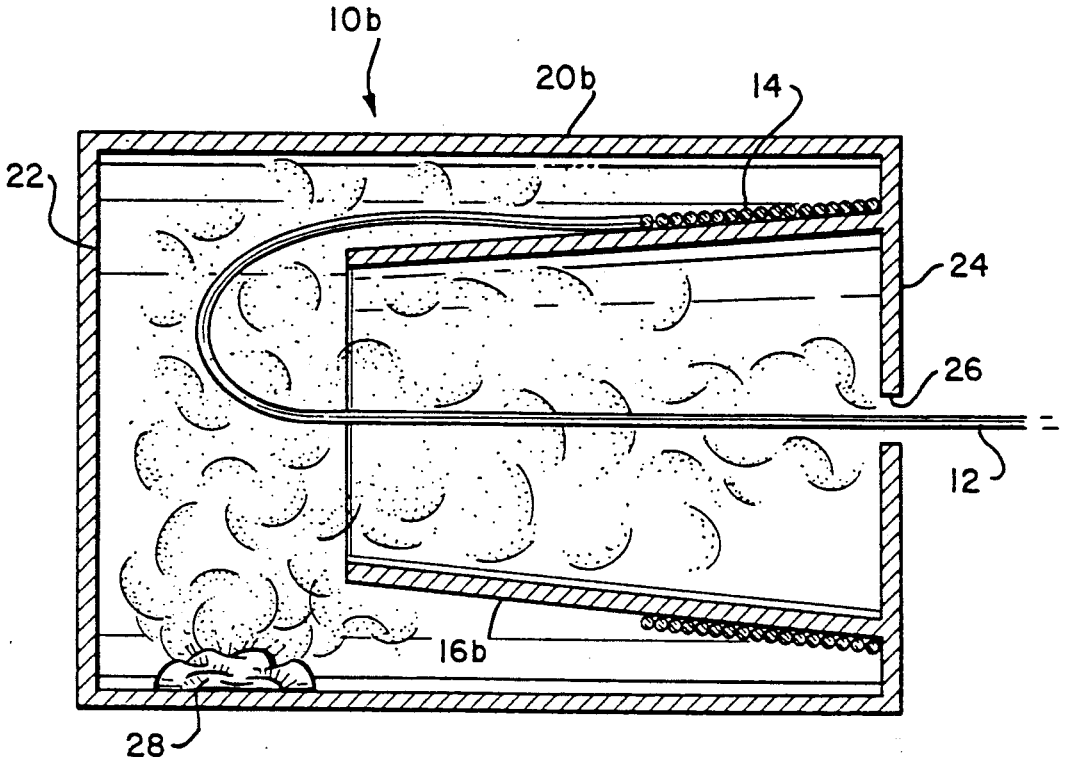
FIG. 3 is a side elevational view of yet another embodiment.

FIG. 2 shows application of the invention to a filament canister 16*a* constructed for inside payout which is advisable for certain uses. Also, FIG. 3 shows an embodiment 10*b* in which the filament 12 is caused to reverse its direction on being taken off the drum 16*b* before passing from enclosure 20*b* through eyelet 26. In both cases the addition of an aerosol mixture either via a spray nozzle or by filament induced turbulent air movement over a quantity of particulate source material can be used to achieve the desired filament braking.

In the practice of the present invention the reduction of filament transverse oscillations acts ultimately to reduce air drag on the dispensing vehicle. Radar cross-section of the vehicle is also reduced. Since filament ducting is possible (e.g., via eyelet) dispensing in a manner to avoid the rocket plume is facilitated. As a result of such ducting, higher speed and longer range missions for the missile are made possible.

Although the present invention has been described in connection with a preferred embodiment, it is to be understood that modifications may be made that come within the spirit of the invention and within the scope of the appended claims. For example, instead of a single component aerosol, multiple components may be used, certain ones of which provide other and different advantageous operational characteristics (e.g., lubricity).

What is claimed is:

1. Dispensing apparatus for filament wound onto a pack, comprising:

wall members defining a hollow enclosure within which the pack is fixedly mounted, one of the wall members having a single opening through which the filament passes on dispensing; and a quantity of a pulverulent material being located within the enclosure which material is induced into an air-borne suspension within the enclosure by the filament movement during dispensing.

2. Dispensing apparatus as in claim 1, in which the enclosure is a hollow cylinder with the wound pack affixed to an inner circular end surface of the enclosure and the eyelet opening is formed in the opposite circular end surface.

3. Dispensing apparatus as in claim 1, in which the pulverulent powder is molybdenum disulfide.

4. Apparatus for dispensing a filament from a missile wound pack data link, comprising:

a hollow enclosure having a single opening mounted within the missile, the wound pack being located within the enclosure with the filament being dispensed through the enclosure opening; and an aerosol mixture within the enclosure having a density exceeding about 10 times that of air at standard pressure and temperature.

5. Apparatus as in claim 4, in which the aerosol mixture consists of a quantity of particulate material located freely within the enclosure and made into an air borne mixture by the filament on dispensing.

6. Apparatus as in claim 4, in which the aerosol mixture is provided from a pressurized source of supply located externally of the enclosure via a nozzle mounted in the enclosure.

7. Apparatus as in claim 4, in which the aerosol mixture has a density not exceeding about, 100 times that of air.

8. Apparatus as in claim 4, in which the pack is wound on the peripheral surface of a tapered cylindrical drum, the cylindrical axis of the drum being arranged generally parallel to the direction of filament dispense.

9. Apparatus for dispensing filament from a wound pack, comprising:

an enclosure for the wound pack including wall members having a single eyelet opening therein through which the dispensed filament passes;

a nozzle mounted in an enclosure wall member directed into the enclosure interior; and a source of supply of a pressurized aerosol connected to the nozzle.

* * * * *

UNITED STATES PATENT AND TRADEMARK OFFICE

CERTIFICATE OF CORRECTION

PATENT NO. : 5,052,636

DATED : October 1, 1991

INVENTOR(S) : Ronald B. Chesler

It is certified that error appears in the above-identified patent and that said Letters Patent is hereby corrected as shown below:

Cover Page

[57] ABSTRACT line 7, instead of the word "brake" insert --damper--.

lines 7-8-9, delete the words "preventing dispense speed exceeding a predetermined desirable maximum" and insert -- dissipating the energy of its rotary motion--.

Column 2, line 26, replace the word "brake" with --damper--.

Column 2, lines 32, 35, 39 and 58 replace the word "braking" with --damping--.

Signed and Sealed this

Fifth Day of July, 1994

Bruce Lehman

*Attest:*

BRUCE LEHMAN

*Attesting Officer*

*Commissioner of Patents and Trademarks*